United States Patent [19]

Tambascio

[11] 4,038,710

[45] Aug. 2, 1977

[54] CROSS RAIL AND SUPPORT FOR BED FRAMES

[75] Inventor: Nickolas A. Tambascio, Willoughy, Ohio

[73] Assignee: Rusco Industries, Inc., Los Angeles, Calif.

[21] Appl. No.: 635,404

[22] Filed: Nov. 26, 1975

[51] Int. Cl.[2] ..... A47C 19/00

[52] U.S. Cl. ..... 5/200 R; 5/181; 5/201; 5/310; 52/632

[58] Field of Search ..... 5/200, 202, 181, 184, 5/305, 280, 310; 52/632; 403/363, 109, 108, 107

[56] References Cited

U.S. PATENT DOCUMENTS

| | | | |
|---|---|---|---|
| 2,658,241 | 11/1953 | Houghton et al. | 52/632 |
| 2,857,602 | 10/1958 | Quintana | 5/286 |
| 2,882,535 | 4/1959 | Sands | 5/310 |
| 2,931,053 | 4/1960 | Andreasen | 5/305 X |
| 3,077,009 | 2/1963 | Taber et al. | 52/632 |
| 3,102,306 | 9/1963 | Hutchinson | 52/632 |
| 3,123,837 | 3/1964 | Paine et al. | 5/310 |
| 3,383,079 | 5/1968 | Costantini et al. | 248/188.8 |
| 3,453,011 | 7/1969 | Meinunger | 403/363 |
| 3,497,881 | 3/1970 | Price | 5/310 |
| 3,623,171 | 11/1971 | Arkin | 5/310 |
| 3,646,623 | 3/1972 | Harris et al. | 5/181 |
| 3,744,068 | 7/1973 | Harris | 5/181 |
| 3,775,783 | 12/1973 | Miller | 5/201 |

FOREIGN PATENT DOCUMENTS

| | | | |
|---|---|---|---|
| 263,416 | 12/1926 | United Kingdom | 5/181 |

*Primary Examiner*—Paul R. Gilliam
*Assistant Examiner*—Victor N. Sakran
*Attorney, Agent, or Firm*—Oldham & Oldham Co.

[57] ABSTRACT

The cross rail and support includes a pair of telescopically engaged cross rail sections each having a ribbed top wall, and a pair of longitudinally ribbed side flanges, each terminating in an upwardly and inwardly directed reinforcing edge portion to provide a sturdy telescopically engaged cross rail member that has support legs attached to laterally outer portions of the support.

3 Claims, 7 Drawing Figures

CROSS RAIL AND SUPPORT FOR BED FRAMES

BACKGROUND OF INVENTION

Heretofore there have been many different patents granted on various types of metal bed frames, cross rail means for the bed frames and bed frame components. It is well known that metal bed frames have appreciable loads applied thereto and bending and turning moments of various types exist on the bed frame cross rails, side rails, and the support legs for the frame. Efforts have been made to reinforce bed frames heretofore and one prior Patent in this field is U.S. Pat. No. 3,497,881.

The manufacture of metal rail bed frames if quite competitive and the costs of bed frames must be held to a minimum consistent with the provision of satisfactory strength in the bed frame and its components. Hence, the use of special reinforcing devices for bed frames is quite beneficial in many instances.

The general object of the present invention is to provide an improved cross rail means for a bed frame to aid in load support thereby and to provide a lengthy service life for a sturdy bed frame made from a minimum amount of metal.

Another object of the invention is to provide a bed frame cross rail support that is made from two cross rail sections each of which is of channel shape in cross section including longitudinally extending reinforcing ribs and/or flanges to improve the strength and load carrying characteristics of the two cross rail sections which are adapted to be telescopically engaged with each other when operatively positioned in engagement with a bed frame.

Further objects of the invention are to provide a separate cross rail means that is readily and optionally engageable with the side rails of a metal angle bed frame, which cross rail means aids in positioning a box spring unit or the like on the bed frame; to provide a cross rail member and support legs therefor where such components are readily secured to each other, which components have a sturdy mechanical construction and good strength; and to provide a support glide that is conveniently engageable with the lower end of the support legs on the cross rail means.

The foregoing and other objects and advantages of the invention will be made more apparent as the specification proceeds.

Attention now is particularly directed to the accompanying drawing, wherein.

When referring to corresponding members shown in the drawings and referred to in the specification, corresponding numerals are used to facilitate comparison therebetween.

SUBJECT MATTER OF INVENTION

Figure 1:
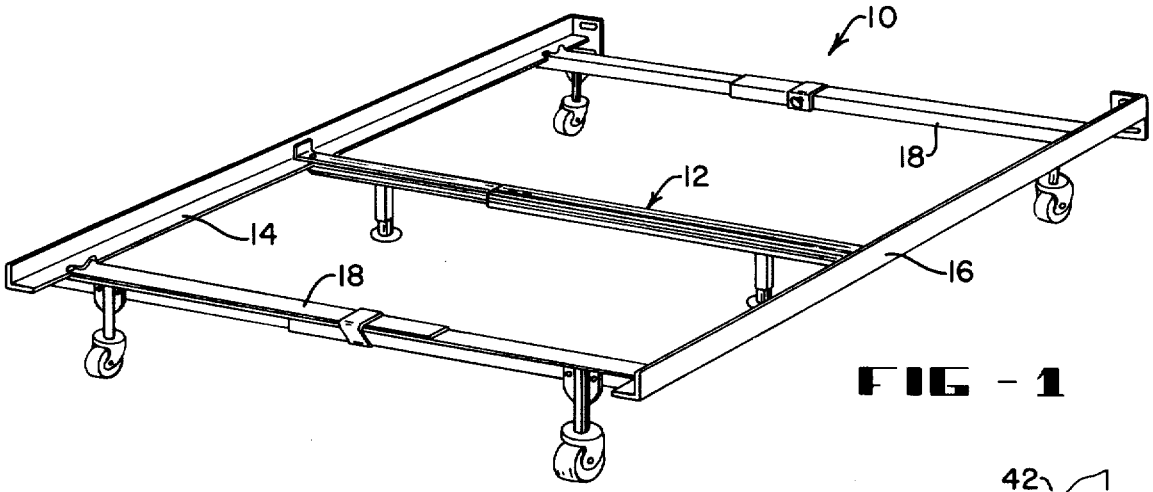
FIG. 1 is a perspective view of a bed frame of a conventional type showing a cross rail means and support leg assembly of the invention operatively associated therewith.

The invention, as one embodiment thereof, relates to a separate cross rail means provided for a bed frame that includes side rails and wherein such cross rail means comprises a pair of telescopically engaged channel type cross rail sections each having a reinforced top wall, and a pair of dependent longitudinally ribbed side walls terminating in upwardly directed reinforcing edge flanges, and support legs engaged with the individual cross rail sections for load support.

Regarding the details of the structure shown in the accompanying drawings, a bed frame is indicated as a whole by the numeral 10 and it includes a center cross rail support or cross rail means 12 of the invention removably associated with and connected to the side rails of the bed frame and extending therebetween for additional load support action and reinforcing action for the bed frame 10.

The bed frame 10 is made from any conventional members such as metal angle side rails 14 and 16 and cross rail units 18 of any known design including that of U.S. Pat. No. 3,775,783, suitably engaging, secured to and extending between longitudinally spaced portions of the opposed side rails 14 and 16. These cross rail units 18 may include pairs of cross rail sections slidably engaged or otherwise suitably engaged with each other to form the generally rectangular bed frame 10.

Figure 2:
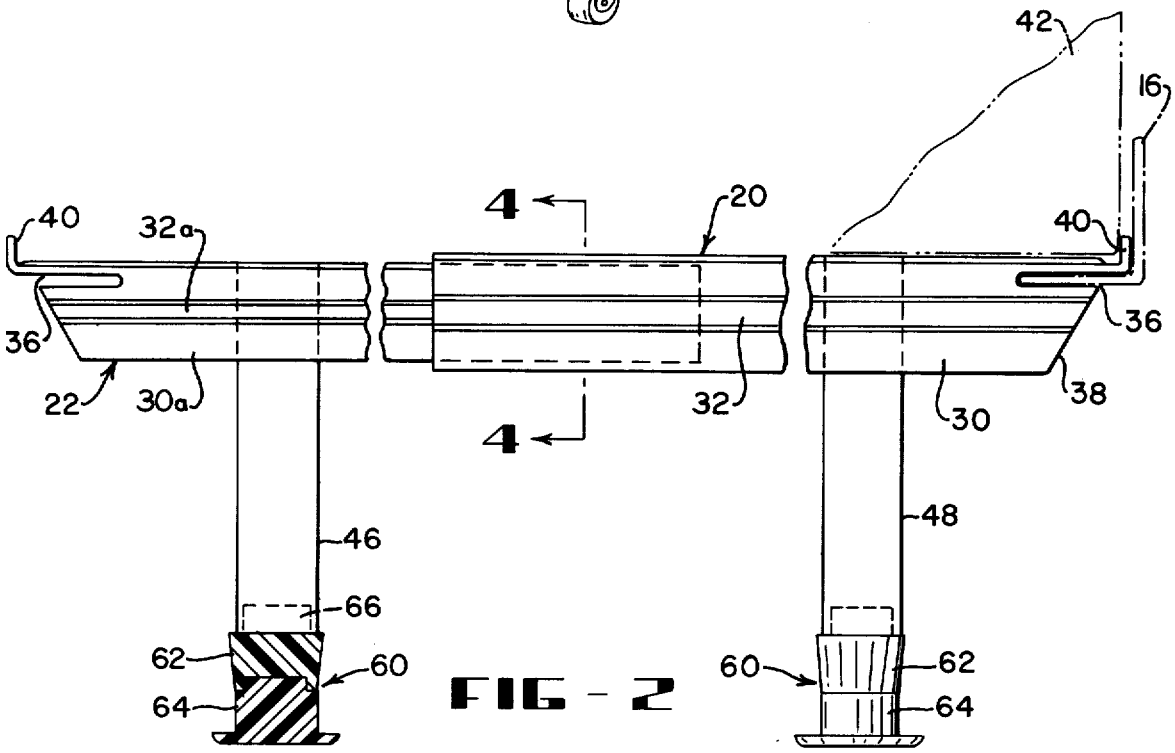
FIG. 2 is a front elevation, partially broken away, and partially shown in section, of the cross rail means and support for bed frames of the invention as shown in FIG. 1.
Figure 3:
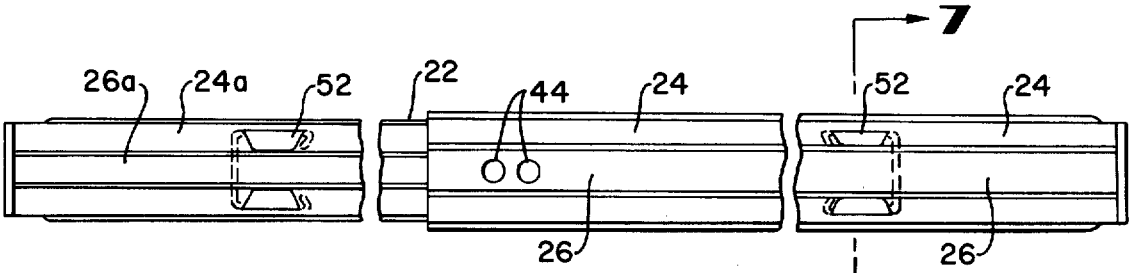
FIG. 3 is a plan of the cross rail means of FIG. 2.
Figure 4:
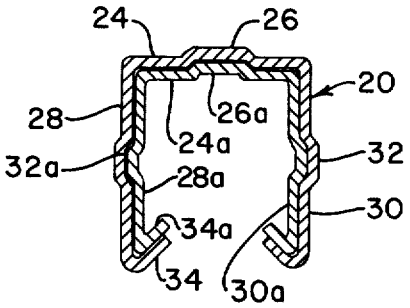
FIG. 4 is a vertical section taken on line 4—4 of FIG. 2.
Figure 6:
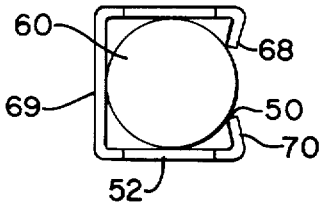
FIG. 6 is a top plan of the structure of FIG. 5.
Figure 5:
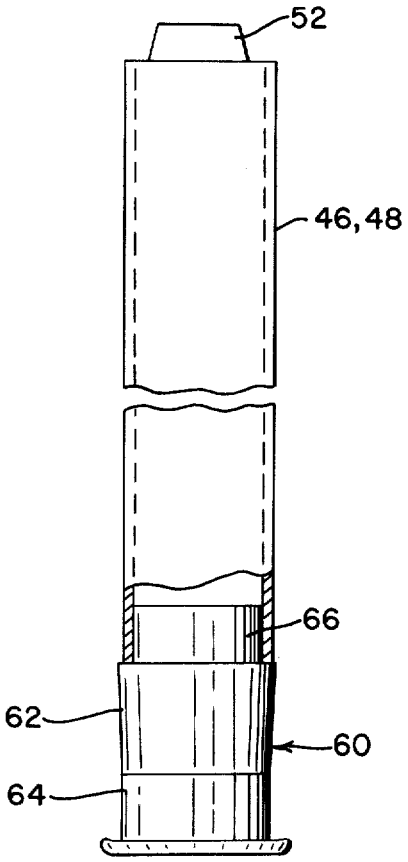
FIG. 5 is a side elevation, partially broken away, of a support leg prior to its engagement with the cross rail support means of the invention.
Figure 7:
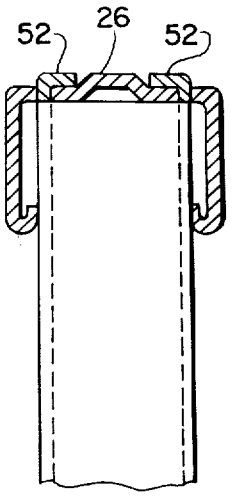
Fig. 7 is a fragmentary vertical section taken on line 7—7 of FIG. 3.

The separate cross rail support member or means 12 of the invention is clearly shown in FIG. 2 and it comprises a pair of telescopically engaged channel shaped cross rail sections 20 and 22 the inner ends of which are telescopically engaged and which have laterally outer ends. The cross rail section 20 is the larger or outer one of the two cross rail sections 20 and 22. It has a top wall 24 with a longitudinally extending reinforcing means therein, such as a rib 26, while a pair of side walls 28 and 30 are formed on the section 20 and each of these walls has a longitudinally extending, outwardly directed reinforcing rib, or other reinforcement, 32 formed thereon. In addition, each of the side walls terminates in an upwardly and inwardly turned reinforcing bottom edge flange or rib 34. The inner and slightly smaller cross rail section 22 is made to corresponding shape of the section 20 and has the same components and reinforcing features as the section 20 with the various components there of being indicated by the corresponding numbers 24*a*, 26*a*, 28*a*, 30*a*, 32*a* and 34*a*. The interengaging ribs and/or grooves 26, 26*a*; 32 and 32*a*; 34 and 34*a* snugly fit with each other for length adjustment and sturdy support action.

A feature of the invention is that the cross rail means 12 are quite sturdy, are of adjustable length, but yet are formed by conventional methods and apparatus from conventional materials and such means can be assembled to any conventional bed frame. Thus, the cross rail sections 20 and 22 are of channel shape in section, but are adapted to provide maximum strength from a relatively thin walled channel member. Adjustment of the length of the engaged cross rail section to engage a specific bed frame is easily made by sliding the sections 20 and 22 with relation to each other.

In order to facilitate and improve engagement of the cross rail units 12 with the bed frame 10, each of the side walls 28, 28*a*, 30 and 30*a* has opposed horizontally aligned slots 36 formed therein from the outer end of the cross rail section. Such slots preferably are formed immediately adjacent the lower surface of the top walls of the cross rail sections and the lower end portions of the section side walls are laterally inwardly slanted as indicated at 38 to avoid any interference between the cross rail unit and the side rails of the bed frame. The frame side rails engage with the cross rail unit or means indicated in dotted lines in FIG. 2. An upwardly turned or extending end flange 40 is formed at the laterally outer end of each of the cross rail sections and this provides good operative engagement with the associated side rails 14 and 16. Also, the slotted construction of the cross rail unit and the flanges 40 on the ends thereof facilitate engaging a box spring support 42 or equivalent member with the bed frame 10 to retain such side rails 14 and 16 in good operative engagement therewith.

Usually the top wall 24 or 24a of each cross rail section has a pair of apertures 44 formed therein adjacent the ends thereof whereby bolts or equivalent means can be engaged with these apertures 44, which are designed to be aligned vertically, when the cross rail sections are telescopically engaged to form a cross rail support of a conventional length. The inner cross rail section 22 may have several sets of the holes provided in longitudinally spaced end portions thereof for alignment with the holes in the outer cross rail section 20 depending upon whether the cross rail unit is to be used with a single, double, queen or king size of a bed frame.

The cross rail support means 12 includes a pair of support legs 46 and 48 that preferably are of the substantially square shape in section, but which have a vertically extending slot 50 extending the length of such support leg. These support legs 46 and 48 initially have a pair of upwardly extending tabs 52 formed on a pair of opposed side walls thereof, which tabs extend through slots provided in the top walls 24 and **24*a* of each of the cross rail sections whereby the tabs can be inserted in such slots in the top walls and be folded laterally inwardly to secure the support legs firmly to the cross rail sections. Normally the tabs 52** terminate short of the upwardly extending top wall ribs provided in these cross rail sections.

The support legs 46 and 48 also have suitable glides 60, usually formed from plastic, engaged with the lower ends thereof and these glides may comprise an upper section 62 and a lower section 64 that telescopically engage each other. The upper section 62 has a cylindrical upper end 66 that is snugly received in and engaged by inwardly turned wall or tab portions 68 and 70 provided adjacent the slot formed in the support leg. Such portions 68 and 70 cooperate with an opposed wall 69 of the support leg to snugly engage the cylindrical upper end of the glide for telescopic engagement therewith.

The separate support means of the invention can be removably engaged with any bed frame for reinforcing the same and to provide effective support action therefor. Normally, the support glides 60 are not in engagement with the support surface for the bed frame 10, but the glides are spaced vertically from the support surface slightly so as to move down into engagement therewith when the center portion of the bed frame is depressed by load applied thereto. However, this spacing can be varied, as desired and any leg support means as desired may be provided on the legs.

By the invention, a removable, sturdy, inexpensive, but effective cross rail support has been provided for bed frames to aid in reinforcing center portions of any bed frame against deflection. The bed frame support means is uncomplicated and can be readily engaged with any bed frame by the average person. Thus, the objects of the invention are thought to be achieved.

While one complete embodiment of the invention has been disclosed herein, it will be appreciated that modification of this particular embodiment of the invention may be resorted to without deaparting from the scope of the invention.

What is claimed is:

1. In a bed frame including side rails, a center cross rail means comprising a pair of telescopically engaged cross rail sections each having an outer end, a longitudinally ribbed top wall and a pair of longitudinally ribbed side flanges each terminating at its lower end in an inwardly and upwardly directed reinforcing edge portion, and support legs individually engaged with individual ones of said cross rail sections adjacent the outer ends thereof, said cross rail sections each being of uniform shape in vertical section for the length thereof and being readily movable axially with relation to each other, a support means engaging a lower end of each support leg, said support legs each having a vertical slot in one side thereof extending the height of the leg and defined by inwardly folded wall edge portions, the lower lengths of such edge portions and an opposite wall of said support leg telescopically engaging the upper ends of said support means to position said support means, and said cross rail sections each have a horizontal slot formed at the outer end thereof in the opposed side flanges thereof to receive a horizontal leg of said side rail therein, and said cross rail sections each having an upwardly turned flange formed from its top wall at the outer end thereof to aid in positioning a bed frame side rail engaged with said slot.

2. A bed frame as in claim 1, where said support legs are of square shape in section and engage with said cross rail sections by a pair of opposed tabs extending up from the top of said support legs, said support legs being vertically below said cross rails and being centered on the longitudinal axis thereof, said top walls extending horizontally, said cross rail sections each having a pair of parallel slots in the top wall thereof through which said tabs extend, said tabs of each leg having portions extending horizontally and engaging the top wall of a said cross rail section and not protruding above the longitudinal rib of the said top wall, which longitudinal ribs protrude upwardly from other areas of said top wall.

3. A cross rail means as in claim 1, where said cross rail sections each has its outer end slanted laterally inward from top to bottom thereof to recess such outer end from the side rail of the bed frame.

* * * * *